US006272870B1

(12) United States Patent
Schaeffer

(10) Patent No.: US 6,272,870 B1
(45) Date of Patent: Aug. 14, 2001

(54) REFRIGERATION SYSTEM HAVING A PRESSURE REGULATING DEVICE

(75) Inventor: Wayne G. Schaeffer, Ballwin, MO (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/427,906

(22) Filed: Oct. 27, 1999

(51) Int. Cl.[7] ..... F25B 41/04
(52) U.S. Cl. ..... 62/205; 62/196.4; 62/210
(58) Field of Search ..... 62/204, 205, 206, 62/208, 209, 210, DIG. 17, 196.4

(56) References Cited

U.S. PATENT DOCUMENTS

| | | | |
|---|---|---|---|
| 4,519,217 | 5/1985 | Phillips et al. | 62/256 |
| 4,522,037 | 6/1985 | Ares et al. | 62/196.4 |
| 4,593,752 | 6/1986 | Tipton | 165/48.1 |
| 4,621,505 | 11/1986 | Ares et al. | 62/509 |
| 4,628,701 | 12/1986 | Phillips et al. | 62/184 |
| 4,711,094 | 12/1987 | Ares et al. | 62/90 |
| 4,750,335 | 6/1988 | Wallace et al. | 62/248 |
| 4,938,034 | 7/1990 | Rosanio et al. | 62/256 |
| 4,990,749 | 2/1991 | Devine et al. | 219/385 |
| 5,048,303 | 9/1991 | Campbell et al. | 62/256 |
| 5,168,715 * | 12/1992 | Nakao et al. | 62/206 X |
| 5,228,581 | 7/1993 | Palladino et al. | 211/153 |
| 5,921,092 | 7/1999 | Behr et al. | 62/81 |
| 5,924,297 | 7/1999 | Wolff et al. | 62/152 |
| 6,044,655 * | 4/2000 | Ozaki et al. | 62/205 |
| 6,053,000 * | 4/2000 | Levitin et al. | 62/205 |

OTHER PUBLICATIONS

Enviroguard[SM] & Enviroguard[SM] II Brochure by Tyler Refrigeration Corporation, Oct. 1998.

* cited by examiner

*Primary Examiner*—Harry B. Tanner
(74) *Attorney, Agent, or Firm*—Howrey Simon Arnold & White, LLP

(57) ABSTRACT

A system for use in regulating the flow of a working fluid, such as a refrigerant, is provided which includes a pressure regulating device. The pressure regulating device controls the mass flow rate of the working fluid in the refrigeration system. The pressure regulating device is controlled based on the saturation characteristics of the working fluid.

20 Claims, 3 Drawing Sheets

REFRIGERATION SYSTEM HAVING A PRESSURE REGULATING DEVICE

BACKGROUND OF THE INVENTION

1. Field of the Invention

This invention relates to heating, venting, and air conditioning (HVAC) and refrigeration systems, and more particularly, to HVAC and refrigerating systems having a device for controlling the flow of fluids.

2. Description pf Related Art

This invention relates to HVAC and refrigeration systems, and in particular to HVAC refrigerating systems having a device for maximizing the efficiency of working fluids. While the invention is described in detail with respect to a conventional refrigeration or HVAC system, those skilled in the art will recognize the wider applicability of the invention disclosed hereinafter. The invention may find application with other refrigeration systems where system efficiency may be improved by monitoring specific parameters affecting that efficiency.

The operational features of conventional refrigeration systems are well known in the art. An example of such a system is a refrigerated container, such as a supermarket display case. In general, the refrigeration system includes a compressor that forces a particular working fluid, such as a refrigerant, used in the system through a condenser where the refrigerant vapor liquefies. The liquid refrigerant passes through a thermostatic expansion valve, expanding the high pressure liquid refrigerant to a low pressure vapor. The low pressure, low temperature refrigerant discharged from the thermostatic expansion valve is then directed through an evaporator for absorbing heat and thus refrigerating the space inside the container surrounding the evaporator.

In conventional refrigeration systems, the condenser is placed in an outdoor setting. It is generally known that decreases in ambient temperature at the condenser cause a proportional decrease in pressure of the refrigerant flowing through the condenser. Thus, a change in outdoor ambient temperature affects the performance of a refrigeration system.

It is desirable to operate a refrigeration system with a minimum condensing pressure. It is well-known that the efficiency of refrigeration system compressors is increased as the condensing pressure in the refrigeration system drops. Therefore, the condensing pressure should operate at an optimal minimum for a given refrigeration system design.

This optimal minimum pressure depends on various factors. For example, it is known that physical characteristics of the compressors require that a higher minimum be maintained than is absolutely required to avoid damage to the compressor itself. Excessively low compression ratios can damage internal components of reciprocating compressors or disable screw compressors due to low oil flow, for example. Further, because of the ambient temperature changes described above, this minimum should be dictated not only by the fixed components of a given refrigeration system, but also by the variable ambient conditions.

To overcome this problem with variable ambient temperatures, it is known to place a mechanical valve immediately downstream of the condenser. This mechanical valve acts to restrict the flow of the refrigerant out of the condenser, thus increasing the pressure of the refrigerant in the condenser. This valve has traditionally been a manually adjustable, mechanical valve with a fixed pressure setting. In this way, depending on the ambient weather conditions, it is possible to partially compensate condenser pressure for changes in ambient temperature.

However, adjusting the mechanical valve is a time-consuming, manual process. Because these mechanical valves are adjusted manually, the mechanical valves are generally not adjusted often, and are definitely not controlled in real time. The lack of real time control thus causes a decrease in the efficiency of the compressor.

Further, it is known that by restricting the flow of the refrigerant through the mechanical valve, the effective heat transfer surface of the condenser is reduced and, in conjunction with varying the fluid flow, results in elevating the system condensing pressure. Thus, it is desirable to actively control the condensing pressure in real time so that compressor efficiency will increase, among other things.

Other problems result from failing to actively control the condenser pressure based on changes in ambient conditions at the condenser. When the ambient temperature exceeds the saturated gas pressure setting of the mechanical valve, poor quality liquid often will result prior to the refrigerant entering the expansion valve. It is generally known that poor quality liquid can lead to a variety of operational problems including the following: improper temperatures at the evaporator and display, poor expansion valve feeding, inadequate sub-cooler capacities, and vapor lock in horizontal line runs.

Improper temperature at the display can be especially troubling in commercial refrigeration systems. In many of such refrigeration system implementations, finer temperature control is desirable. With the example grocery store case refrigeration system, several factors fuel the need for finer case temperature control. Government regulations may require more stringent temperature regulation, and requirements for longer product shelf life and improved product quality further make tighter control of case temperature a necessity. Moreover, if the ambient temperature changes, the process of manually adjusting the mechanical valve to adjust condenser pressure must be repeated.

Another problem exists with using the mechanical valve to adjust condenser pressure for changes in ambient temperature: these systems will not work properly with the gas defrost process. Gas defrost methods divert high pressure superheated or saturated gas from the compressor discharge or the receiver respectively to the evaporator that has ice formed on it. As the gaseous refrigerant condenses, the rejected heat melts the unwanted ice. Gas defrost is generally known to be the most efficient method of defrosting low temperature display cases. However, when the mechanical valve is set for optimum compressor energy efficiency, the refrigeration system is not capable of properly defrosting the evaporators. This lack of energy efficiency in the gas defrost process negates any energy efficiency improvements by utilizing the mechanical valve.

It is therefore desirable to control condenser pressure in real time such that it can be kept to a workable minimum thereby improving compressor efficiency. It is also desirable to control this condenser pressure in a way such that the gas defrost process can be utilized without decreasing the efficiency of the refrigeration system. Further, it is desirable to control condenser pressure while supplying high quality liquid refrigerant to the expansion value.

The present invention addresses these, and other, shortcomings associated with the prior art.

SUMMARY OF THE INVENTION

In one aspect of the invention, a system is provided for refrigerating a container, the system comprising a compressor for propelling a work fluid through the refrigeration system, a condenser coupled to the compressor, a pressure regulating device coupled to the condenser, a receiver coupled to the pressure regulating device, an expansion valve coupled to the receiver, an evaporator coupled to the expansion valve, a temperature sensor being situated between the receiver and the expansion valve, and a pressure sensor being situated between the receiver and the expansion valve, the pressure regulating device controlling flow of the work fluid through the refrigeration system in response to the readings from the temperature sensor and the pressure sensor. In some embodiments, a diverting valve and a gas defrost header to perform a gas defrost operation is provided. In some embodiments, a downstream pressure regulator is provided.

In another aspect of the invention, a method of refrigerating a container is provided that comprises (1) providing a refrigeration system comprising a compressor for propelling a work fluid through the refrigeration system, a condenser coupled to the compressor, a pressure regulating device coupled to the condenser, a receiver coupled to the pressure regulating device, an expansion valve coupled to the receiver, an evaporator coupled to the expansion valve, a temperature sensor being situated between the receiver and the expansion valve, and a pressure sensor being situated between the receiver and the expansion valve, the fluid flow regulating device controlling flow of the refrigerant through the refrigeration system in response to the readings from the temperature sensor and the pressure sensor; and (2) controlling the pressure regulating device to regulate the pressure of the working fluid at the condenser.

BRIEF DESCRIPTION OF THE DRAWINGS

Other objects and advantages of the invention will become apparent upon reading the following detailed description and upon reference to the drawings in which.

Figure 1:
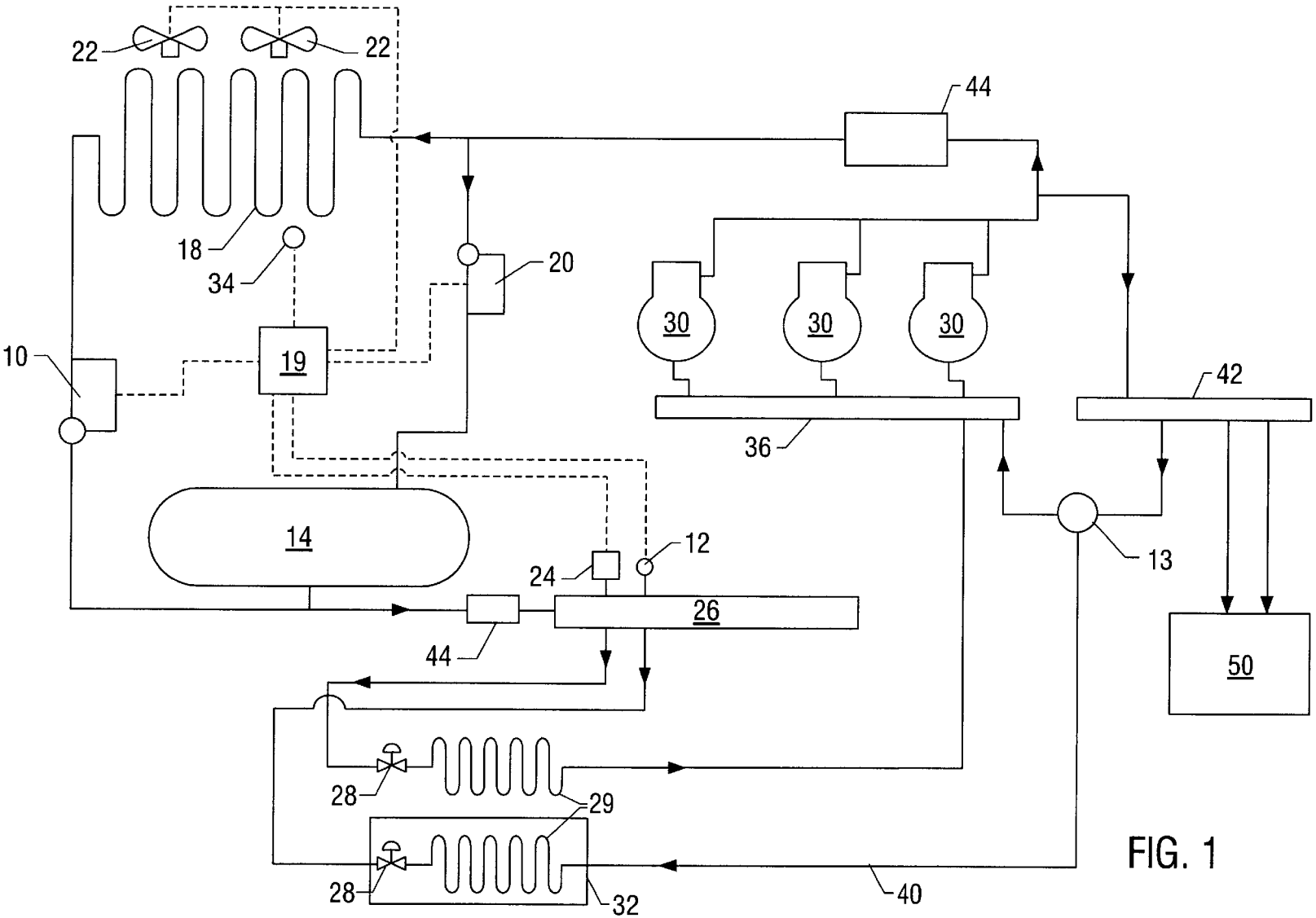
FIG. 1 is a schematic drawing of a typical refrigeration system including a fluid control device in accordance with an embodiment of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

FIG. 1 illustrates a typical refrigeration system employing a pressure regulating device 10, in accordance with an embodiment of the current invention. A system as illustrated in FIG. 1 may be used, for example, to refrigerate a display 32 such as a grocery display case containing meat, frozen vegetables, etc. Compressors 30 provide the motive force for the fluid, or refrigerant, circulated within the system. The direction of the flow of the refrigerant is indicated by arrows on the lines between the illustrated components. The compressors 30 force the working fluid through condenser 18, surge receiver 14, liquid header 26, expansion valves 28, and evaporators 29 in a manner well known in the art, thus cooling display 32. Refrigerant exits evaporator 29 to return to compressor 30 via suction heater 36. Gas defrost differential valves 44 are located between compressors 30 and condenser 18, and between surge receiver 14 and liquid header 26. Gas defrost differential valves act to control the flow of the working fluid via manner described more fully below. The fluid control device 10 controls fluid flow between condenser 18 and surge receiver 14 in a manner described more fully below.

A controller 19 controls actuation of the fluid control device 10 in response to a signal received from a temperature sensor 12, which may be located at liquid header 26, and pressure transducer 24, which also may be located at liquid header 26. Alternatively, temperature sensor 12 may be located upstream of surge receiver 14. As noted above, the invention is widely applicable in a variety of fluid control situations and, although fluid control device 10 may be a pressure regulator valve, the invention is not so limited.

In one embodiment of the invention, pressure regulator valve 10 is a direct acting stepper motor driven valve incorporating a selective number of predetermined discrete steps. However, one of ordinary skill in the art would realize that any alternative motor designs would be applicable. In one embodiment, the number of discrete steps would be 800. These discrete steps initiate the opening and closing of a variable sized passage which alter mass flow of the refrigerant. In the embodiment shown in FIG. 1, pressure regulating device 10 is shown downstream of condenser 18 and before surge receiver 14. However, one skilled in the art would realize that a liquid distribution system, or a non-surge receiver, could replace surge receiver 14.

In the embodiment of the invention shown, controller 19—associated with a suitable control software algorithm, as is well known in the art—receives inputs from pressure transducer 24, temperature sensor 12, and ambient temperature sensor 34. Depending on the operating conditions desired, controller 19 controls the rate at which fans 22 operate to cycle the fans to optimize the number of fans operating based upon ambient temperature measured by ambient temperature sensor 34. Further, controller 19 regulates pressure regulating device 10, which in turn adjusts the condenser pressure. Finally, controller 19 adjusts downstream pressure regulator 20 as described herein. Controller 19 could be any type of control system, including a commercially available microprocessor system.

Downstream pressure regulator 20 is shown located in a conduit between the high pressure discharge gas conduit exiting compressors 30 and surge receiver 14. Downstream pressure regulator 20 diverts high pressure gas to the receiver to compensate for any pressure drop created by pressure regulator valve 10. However, downstream pressure regulator 20 could be configured in numerous ways. For instance, downstream pressure regulator 20 could be configured as a stepper motor driven valve varying in conjunction with pressure regulator valve 10. Or downstream pressure regulator 20 can be a differential check valve set to operate at a predetermined fixed pressure differential. Also, the downstream pressure regulator may be an adjustable pressure differential valve. The pressure differential between the condenser pressure and the pressure near surge receiver 14 compensates for variances in pressure drop due to piping and mass flow.

Although multiple compressors 30 are shown in FIG. 1, each embodiment shown could be applied to conventional refrigeration systems utilizing a single compressor.

Also shown in FIG. 1 is diverting valve 13. When a gas defrost cycle is desired, diverting valve 13 opens thus forcing the compressed refrigerant from the compressor discharge and the gas defrost header 42 through the suction line 40 to evaporator 29. Diverting valve 13 and defrost header 42 could also be connected to the top of surge receiver 14. Once passing through valve 13, the defrost gas passes backwards through the suction line 40, then to the evaporator 29 where it condenses and is returned to the system via the liquid line thus reversing the flow of refrigerant. When the gas defrost cycle is desired, gas defrost differential valves 44 may also be included to assure the reverse flow of fluid through the system. Similarly, gas defrost header 42 may supply refrigerant to other evaporators 50 for the gas defrost process.

In this way, this embodiment of the invention allows the hot refrigerant to melt the unwanted ice off the evaporator. Thus, in this embodiment, control of the condensing pressure is achieved while maintaining the ability of the refrigeration system to perform the desirable gas defrost process.

This defrost system can be enhanced through the use of the pressure regulator valve 10. For instance, pressure regulator valve 10 is capable of raising the discharge pressure of a system just before or during a defrost. This enhances the performance of a refrigeration system. Pressure regulator valve 10 may also vary the system pressure during the defrost to achieve optimum defrosting. For example, a system may operate at 40° F. condensing pressure. Two minutes prior to a scheduled defrost, the pressure regulator valve 10 is closed thus raising the condensing pressure to 75° F. condensing pressure. The defrost is initiated, and after 10 minutes, the defrost ends. Pressure regulator valve 10 then is then opened to allow the condensing pressure to be lowered to 40° F. again.

Similarly, the system condensing pressure could be raised or lowered contingent upon if a heat reclamation process is desired. A heat reclaim action process diverts all or a portion of the compressor discharge gas to a heat exchanger (not shown) and then to the condenser. The heat exchanger could then be used to heat potable water or to heat store air.

Temperature sensor 12 can be any type of sensor, such as a commercially available thermal couple. Further, pressure transducer 24 can be an analog pressure transducer. The location of both pressure transducer 24 and temperature sensor 12 may vary, as controller 19 can take this location into consideration. For instance, pressure transducer 24 could be located on the discharge gas conduit with the controller 19 making adjustments to allow for a five pound pressure drop through the condenser 18.

Figure 2:
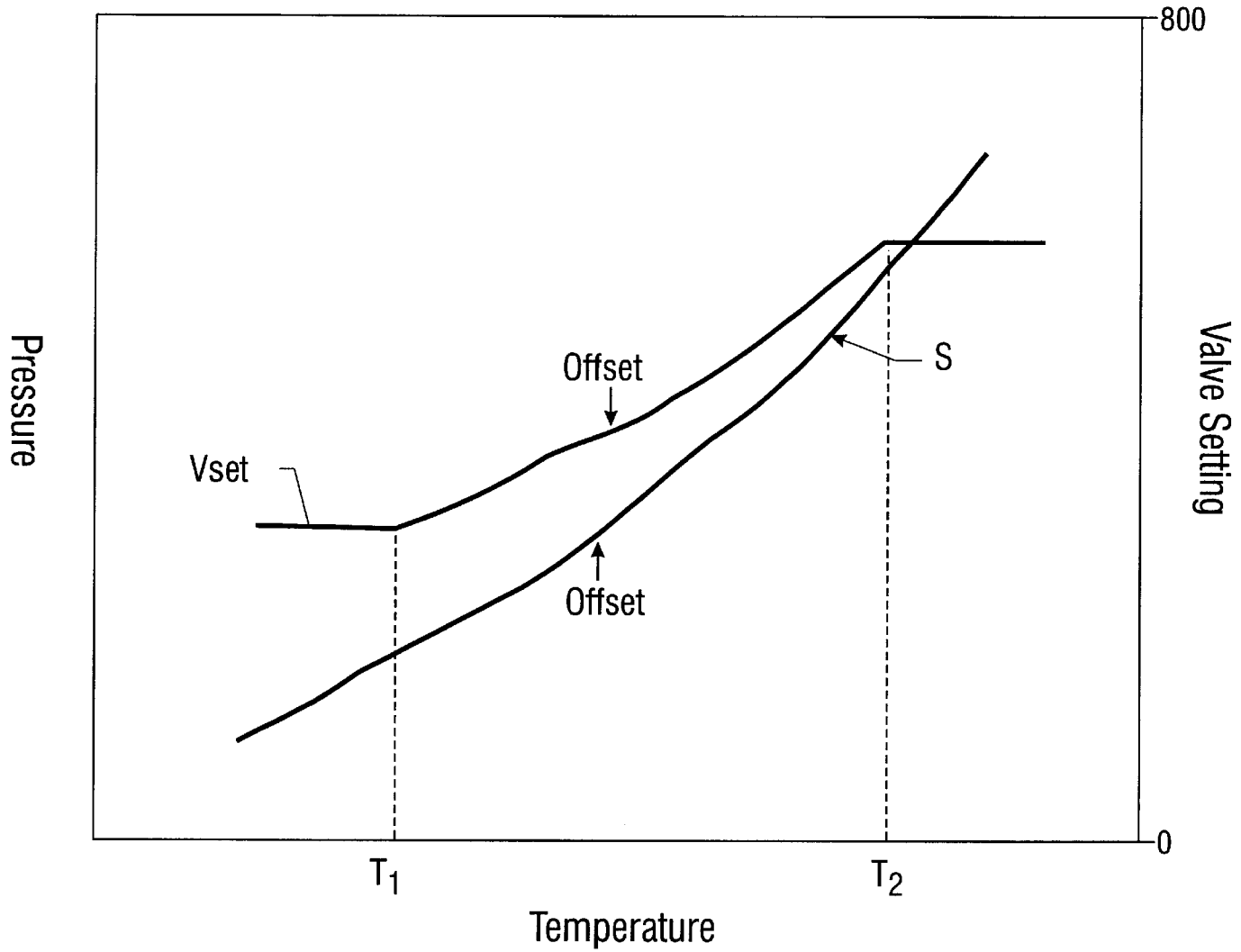
FIG. 2 is a graph describing, among other things, a saturation curve for a given refrigerant.

FIG. 2 illustrates a saturation curve for a given refrigerant utilized in a refrigeration system. Such curves and lookup tables are readily available for refrigerants common in the industry. Controller 19 in FIG. 1 utilizes information contained in the saturation curve to control fluid control device 10 and downstream pressure regulator 20. Such a saturation curve serves as the basis of controlling pressure regulating device 10. Pressure regulating device 10 steps open or closed based upon the saturation curve to maintain a minimum amount of subcooling, i.e. an optimum condenser pressure. By keeping condenser pressure at the lowest possible value, but still capable of assuring liquid feed at the expansion valve and being capable for performing the gas defrost operation, the performance of the commercial refrigeration system is greatly enhanced.

Referring to the graph of FIG. 2, saturation curve S plots the saturation point for a given refrigerant for ranges of pressure plotted against temperature. It is known that for pressure and temperature ranges above the S curve, the refrigerant is in a liquid state, while for values below the S curve, the refrigerant is in a gaseous state.

As mentioned above, it is desirable to operate with a minimal condenser pressure. It is also desirable have a minimum and maximum pressure value for the condenser pressure to protect the various components of the system from overload, or, alternatively, to protect the compressors from having too low of a compression ratio. Finally, it is desirable to deliver high-quality liquid refrigerant to the expansion valve 28 to improve system efficiency.

To this end, an optimal value for the setting of the pressure regulating device 10 can be determined based on the saturation curve. This value is proportional to the saturation curve as shown in FIG. 2 to ensure that high quality liquid is delivered to the expansion valve 28. Also shown on the right hand axis is the valve setting ("$V_{SET}$") corresponding to the points ABOVE the saturation curve as described below. Values for $V_{SET}$ are empirically determined. In FIG. 2, the values for the valve settings are shown to be from 0 to 800 increments of the stepper motor being used. However, any number of values would suffice. The important point is that the desired settings correspond to the saturation curve as shown.

Pressure values from pressure transducer 24, and temperature values from temperature sensor 12 can be used to locate values for $V_{SET}$ on the curve. The controller then sends a signal corresponding to $V_{SET}$ to the pressure regulating device 10. Pressure regulating device 10 then either expands or contracts to alter the mass flow rate of the refrigerant passing through it. In this way, the condenser pressure can be continuously controlled. Further, because value of $V_{SET}$ is empirically derived to correspond to set points for pressure and temperature coordinates that are ABOVE the saturation curve, this embodiment of the invention assures that high quality liquid will be delivered to the expansion valve.

An offset is shown to be the difference between the saturation curve and the $V_{SET}$ value. This offset provides a margin of safety for the operation of the system to ensure high quality liquid is delivered to expansion valve 28. The value of the offset may vary for differing refrigeration systems. For example, it may correspond to a fixed value, or it may converge at $T_z$ and diverge toward $T_i$ as shown. However, it is imperative that at all pressure and temperature coordinates corresponding to $V_{SET}$, these coordinates remain above the saturation curve.

Unlike the prior art in which the mechanical valve setting did not vary with changes in pressure and temperature, this embodiment of the invention allows for improvement in efficiency based on valve settings that vary with operating conditions measured in real time.

Further, to prevent damage to the compressors and other working components, the system described in this embodiment has upper and lower pressure limits (corresponding to $T_1$ and $T_2$).

Thus, because $V_{SET}$ will always be located above the saturation line because of the offset, $V_{SET}$ ensures that high quality liquid is being fed to the liquid header and the expansion valve at all times. This allows the system to operate at the lowest possible condenser pressure. Further, this allows for means for controlling the condensing pressure of the commercial refrigeration system in such a way as to maintain a minimum condenser pressure sufficient only (1) to assure liquid feed to the expansion valve and (2) to allow gas defrost. Because the condensing pressure is kept to a minimum, compressor efficiency is increased thus resulting in a saving of energy and operating expense.

Figure 3:
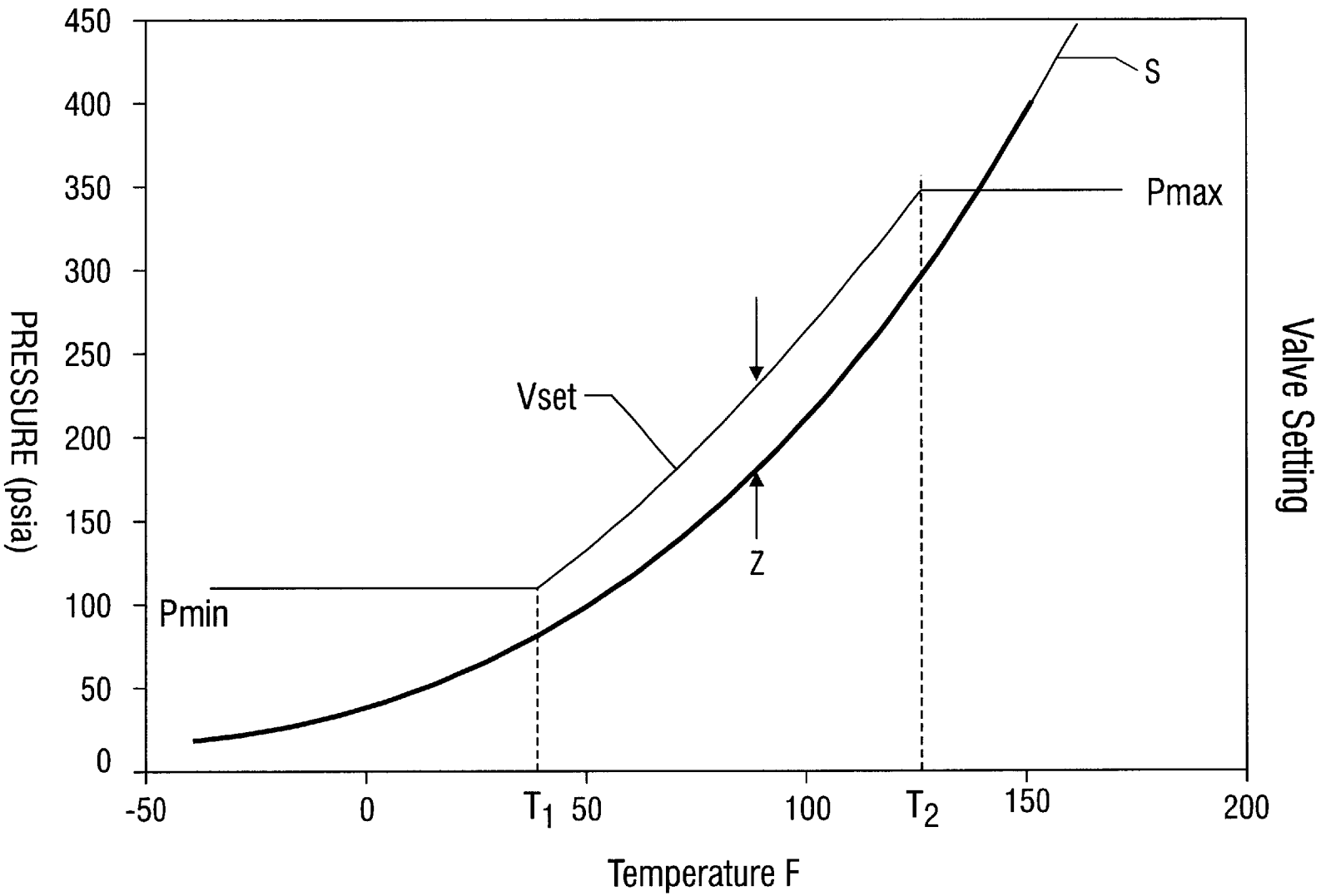
FIG. 3 is a graph showing, among other things, the valve settings for a range of temperatures and pressures.

Referring now to FIG. 3, a saturation curve for a given refrigerant—R-22—is shown. It is known in the industry and from standard lookup tables that the R-22 Pressure Temperature curve may be represented as follows:

$$\text{Pressure}=a+bx+cx^2+dx^3+ex^4$$

Where:

a=38.648273 b=0.81350047 c=0.0065795461 d=2.2581365e-05 e=2.2116922e-08 and x corresponds to the particular temperature on the graph, in degrees Fahrenheit.

To determine the value of $V_{SET}$ in this particular embodiment, the values for $V_{SET}$ may be calculated based upon knowing a given offset, Z.

$$\text{Desired Pressure}=a+bx+cx^2+dx^3+ex^4+Z$$

where:

a=38.648273 b=0.81350047 c=0.0065795461 d=2.2581365e-05 e=2.2116922e-08

Z=desired offset for a given margin of safety.

For example, Z can be 25 as shown in FIG. 3. From this pressure level, the corresponding value for $V_{SET}$ can be determined by utilizing the right hand vertical axis on the graph.

As mentioned above, it is desirable to operate with a minimal condenser pressure. It is also desirable to have a minimum and maximum pressure value for the condensing pressure in order to protect the compressors from having a too low compression ratio. Such pressures are shown as $P_{MIN}$ and $P_{MAX}$ on FIG. 3, or 100 p.s.i.a. and 350 p.s.i.a. respectively.

As shown and desired, all values for the desired pressure—and thus the values for the $V_{SET}$ are ABOVE saturation curve S. Controller 19 utilizes information contained in FIG. 3 to control fluid control device 10 and downstream pressure regulator 20. In this way, this embodiment ensures that high quality liquid is being fed to the liquid header and expansion valves at all times. This allows the system to operate at the lowest possible condenser pressure. Further, this allows for means for controlling the condensing pressure of a commercial refrigeration system in such a way as to maintain a minimum condenser pressure sufficient only (1) to assure liquid feed to the expansion valve, and (2) to allow gas defrost by providing high quality fluid.

It will be appreciated by those of ordinary skill in the art having the benefit of this disclosure that the embodiment illustrated above is capable of numerous variations without departing from the scope and spirit of the invention. It is fully intended that the claimed invention encompasses within its scope all such variations without being limited to the specific embodiment disclosed above. Accordingly, the exclusive rights sought to be patented are as described in the claims below.

What is claimed is:

1. A system for refrigerating a container, the system comprising:

(a) a compressor for propelling a working fluid through the refrigeration system;

(b) a condenser coupled to the compressor;

(c) a pressure regulating device coupled to the condenser;

(d) a receiver coupled to the pressure regulating device;

(e) an expansion valve coupled to the receiver;

(f) an evaporator coupled to the expansion valve;

(g) a temperature sensor being situated between the receiver and the expansion valve; and (h) a pressure sensor being situated between the receiver and the expansion valve;

the pressure regulating device controlling flow of a working fluid through the refrigeration system in response to the readings from the temperature sensor and the pressure sensor.

2. The system of claim 1 further comprising a downstream pressure regulator coupled between the compressor and the receiver to compensate for pressure drops.

3. The system of claim 2 wherein the downstream pressure regulator is a stepper motor driven valve that varies in conjunction with the pressure regulating device.

4. The system of claim 2 wherein the downstream pressure regulator is a differential check valve.

5. The system of claim 2 in which the downstream pressure regulator is an adjustable pressure differential valve.

6. The system of claim 1 in which the pressure regulating device is a direct acting stepper motor driven valve.

7. The system of claim 6 in which the direct acting stepper motor driven valve has 800 discrete steps.

8. The system of claim 1 further comprising a saturation curve for the working fluid, the pressure regulating device being controlled in proportion to the saturation curve.

9. The system of claim 8 in which the working fluid is R-22 having a saturation curve, said saturation curve being defined as:

$$\text{Pressure}=a+bx+cx^2+dx^3+ex^4$$

where:

a=38.648273 b=0.81350047 c=0.0065795461 d=2.2581365e-05 e=2.2116922e-08 and x corresponds to the particular temperature on the graph, in degrees Fahrenheit;

said pressure regulating device being controlled in proportion a desired value for condensing pressure being defined as:

$$\text{Pressure}=a+bx+cx^2+dx^3+ex^4+Z$$

where:

a=38.648273 b=0.81350047 c=0.0065795461 d=2.2581365e-05 e=2.2116922e-08, and

Z=desired offset for a given margin of safety.

10. The system of claim 9 in which Z is 25.

11. The system of claim 1 further comprising a microprocessor functionally associated with the pressure regulating device to control the flow of the work fluid.

12. The pressure regulating device of claim 1 in which said working fluid is a refrigerant.

13. The system of claim 1 further comprising;

a gas defrost header being connected to said compressor;

a diverting valve being located between the gas defrost header and the evaporator, said diverting valve reversing the flow of the working fluid for a gas defrost process.

14. The system of claim 13 further comprising a gas defrost differential valve being situated between said compressor and said condenser.

15. The system of claim 13 further comprising a gas defrost differential valve being situated between said receiver and said liquid header.

16. The system of claim 1 further comprising a controller being connected to the pressure regulating device to control the pressure regulating device.

17. The system of claim 1 further comprising a heat exchanger, said heat exchanger being connected to said compressor to remove heat from said working fluid.

18. A system for refrigerating a container, the system comprising:

a compressing means for propelling a work fluid through the refrigeration system;

condensing means, to increase the pressure of the working fluid, coupled to the compressing means;

pressure regulating means, to control the pressure of the working fluid, coupled to the condensing means;

receiving means, to hold the working fluid, coupled to the pressure regulating means;

expansion means, to allow the working fluid to expand coupled to the receiving means;

evaporating means coupled to the expansion means;

means for sensing temperature being situated between the receiving means and the expansion means;

means for sensing pressure, being situated between the receiving means and the expansion means; and means for controlling the pressure regulating means electrically connected to the means for sensing pressure and the means for sensing temperature.

19. A method of refrigerating a container, the method comprising:

(a) providing a refrigeration system comprising:

a compressor for propelling a work fluid through the refrigeration system;

a condenser coupled to the compressor;

a pressure regulating device coupled to the condenser;

a receiver coupled to the pressure regulating device;

an expansion valve coupled to the receiver;

an evaporator coupled to the expansion valve;

a temperature sensor being situated between the receiver and the expansion valve; and a pressure sensor being situated between the receiver and the expansion valve;

the pressure regulating device controlling flow of the refrigerant through the refrigeration system in response to the readings from the temperature sensor and the pressure sensor; and (b) controlling the pressure regulating device to regulate the pressure of the working fluid at the condenser.

20. A system for refrigerating a container, the system comprising:

(a) a compressor for propelling a refrigerant through the refrigeration system;

(b) a condenser coupled to the compressor;

(c) a direct acting stepper motor driven valve coupled to the condenser;

(d) a receiver coupled to the diverting valve;

(e) an expansion valve coupled to the receiver, the evaporator being coupled to the expansion valve;

(f) a temperature sensor being situated between the receiver and the expansion valve;

(g) a pressure sensor being situated between the receiver and the expansion valve;

(h) a diverting valve being situated between the compressor and the evaporator; the direct acting stepper motor driven valve controlling flow of the work fluid through the refrigeration system in response to the readings from the temperature sensor and the pressure sensor; and (i) a downstream pressure regulator coupled between the compressor and the receiver.

* * * * *